US007476159B2

(12) United States Patent
Walworth

(10) Patent No.: US 7,476,159 B2
(45) Date of Patent: Jan. 13, 2009

(54) PUTTING METHOD AND APPARATUS

(76) Inventor: Jimmy H. Walworth, 10709 Pontofino Cir., Trinity, FL (US) 34655

( * ) Notice: Subject to any disclaimer, the term of this patent is extended or adjusted under 35 U.S.C. 154(b) by 29 days.

(21) Appl. No.: 11/697,854

(22) Filed: Apr. 9, 2007

(65) Prior Publication Data

US 2008/0248892 A1 Oct. 9, 2008

(51) Int. Cl.
*A63B 53/14* (2006.01)

(52) U.S. Cl. ..... 473/294; 473/300; 473/409

(58) Field of Classification Search ..... 473/294, 473/296, 298–299, 300–303, 409
See application file for complete search history.

(56) References Cited

U.S. PATENT DOCUMENTS

| | | | | |
|---|---|---|---|---|
| 1,561,349 | A | 11/1925 | Murphy et al. | |
| 2,092,839 | A * | 9/1937 | Gouverneur | 473/203 |
| 4,491,323 | A * | 1/1985 | Kozub | 473/203 |
| 5,531,446 | A | 7/1996 | Scheie et al. | 473/227 |
| 5,830,081 | A * | 11/1998 | Kitahara | 473/294 |
| 6,001,033 | A * | 12/1999 | Tucker | 473/409 |
| 6,071,202 | A * | 6/2000 | Densberger et al. | 473/409 |
| 6,296,577 | B1 * | 10/2001 | Trammell et al. | 473/340 |
| 6,447,403 | B1 * | 9/2002 | Schmidt | 473/251 |
| 7,396,289 | B2 * | 7/2008 | Soracco et al. | 473/251 |
| 2002/0183130 | A1 * | 12/2002 | Pacinella | 473/239 |
| 2004/0259660 | A1 * | 12/2004 | Zichmanis | 473/300 |

* cited by examiner

*Primary Examiner*—Stephen L. Blau
(74) *Attorney, Agent, or Firm*—Donald J. Ersler

(57) ABSTRACT

An improved putting method and apparatus include an improved putter and a swinging stance of specific features. The improved putter includes a putter head, a shaft and a handle. The putter head is attached to one end of the shaft and the handle is formed on the other end of the shaft. The handle includes a gripping portion, which is terminated with a substantially spherical ball. The elements of the swinging method include resting a back of one hand against a leg thigh; placing the substantially spherical ball into the palm of the one hand; grasping the spherical ball with the fingers and thumb of the one hand; grasping the gripping portion with the other hand; and retracing an arcuate path to strike the golf ball. Preferably, the one hand is closest to the target. The putter head is preferably swung parallel to the ground.

13 Claims, 4 Drawing Sheets

PUTTING METHOD AND APPARATUS

BACKGROUND OF THE INVENTION

1. Field of the Invention

The present invention relates generally to golf and more specifically to an improved putting method and apparatus, which enables a golfer to decrease the amount of variation during a putting stroke.

2. Discussion of the Prior Art

Putting methods and club designs have not changed dramatically for the last 100 years. The result of this lack of change has been a lack of improvement in putting skills by amateur golfers as well as professional golfers. The traditional putting methods are plagued with numerous sources of potential error, resulting in making the action so difficult that even few professionals have been able to master the task. Furthermore, the great plethora of putter designs that are introduced to the marketplace yearly gives testimony to the fact that very few putter designs include all of the features that are necessary to optimize the equipment for the intended task of even traditional putting methods, even though the sport is approximately 400 years old.

U.S. Pat. No. 1,561,349 to Murphy et al. discloses a golf club. The Murphy et al. patent includes a golf club with a substantial ball formed on a handle end. U.S. Pat. No. 5,531,446 to Scheie et al. discloses a golfer's putting aid. The Scheie et al. patent provides a putting aid for a golf putter comprising an elongated rod and a generally spherical end member mounted on the rod. The generally spherical section contacts a portion of the torso of a golfer. U.S. Pat. No. 6,447,403 to Schmidt discloses a method and apparatus for improving putting skill. The Schmidt patent includes an improved putter design and a swinging stance of specific features.

Accordingly, there is a clearly felt need in the art for an improved putting method and apparatus, which decreases the variation encountered during a putting swing and provides for a putter, which is designed to optimize the properties critical to successful execution of such an improved putting stroke.

SUMMARY OF THE INVENTION

The present invention provides an improved putting method and apparatus for improving putting skill. An improved putting method and apparatus include an improved putter and a swinging stance of specific features. The improved putter includes a putter head, a shaft and a handle. The putter head is attached to one end of the shaft and the handle is formed on an opposite end of the shaft. The handle includes a gripping portion, which is terminated with a substantially spherical ball. The length of the shaft is at least 18 inches to conform to the United States Golfing Association (USGA) rules. Further to conform to USGA rules, the shaft must be bent within the first five inches from the insertion point into the putter head in such a manner as to tilt the shaft a minimum of 10 degrees toward the golfer in the formal putting address position.

The elements of the swinging method include resting a back of one hand against a leg thigh; placing the substantially spherical ball into the palm of the one hand; grasping the spherical ball with the fingers and thumb of the one hand; grasping the gripping portion with the other hand; and retracing an arcuate path to strike the golf ball. Preferably, the one hand is closest to the target. The putter head is preferably swung parallel to the ground. The putter head may be slid on the green or slid slightly above the green during the putting swing. It is preferable that the golfer orient his head such that his eyes look substantially vertically downward on the golf ball.

Accordingly, it is an object of the present invention to provide an improved method of swinging an improved putter, which allows a golfer to dramatically increase the controllability of the ball's path and therefore decrease the number of strokes during a round of golf.

These and additional objects, advantages, features and benefits of the present invention will become apparent from the following specification.

DETAILED DESCRIPTION OF THE PREFERRED EMBODIMENTS

Figure 1:
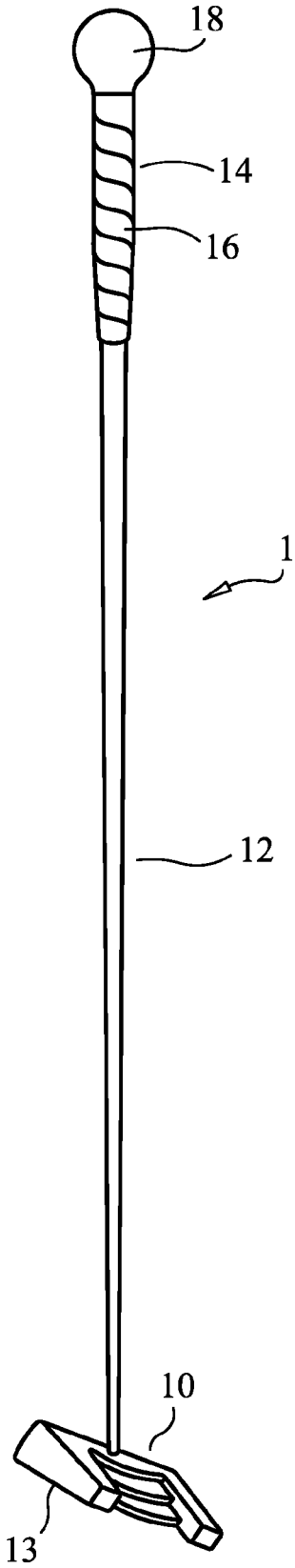
FIG. 1 is a perspective view of an improved putter of an improved putting method and apparatus in accordance with the present invention.
Figure 2:
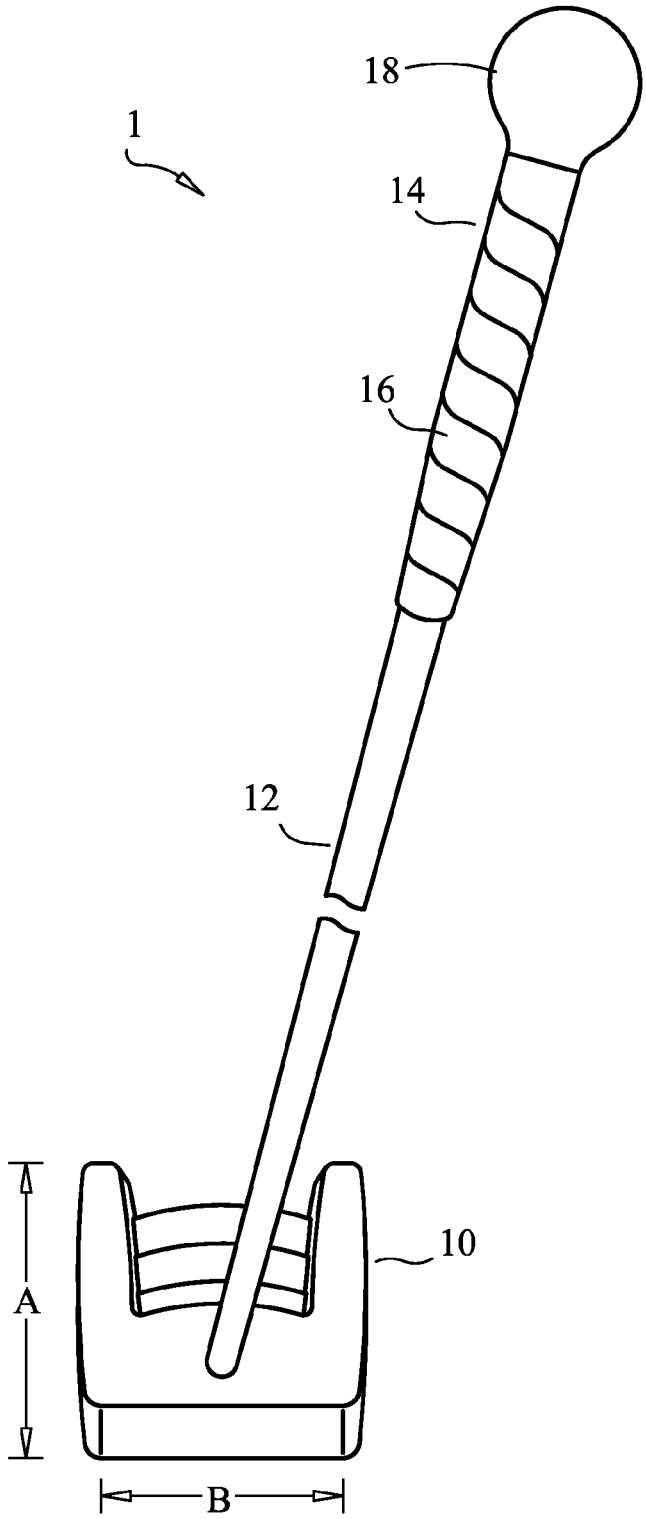
FIG. 2 is a front perspective view of an improved putter of an improved putting method and apparatus in accordance with the present invention.
Figure 3:
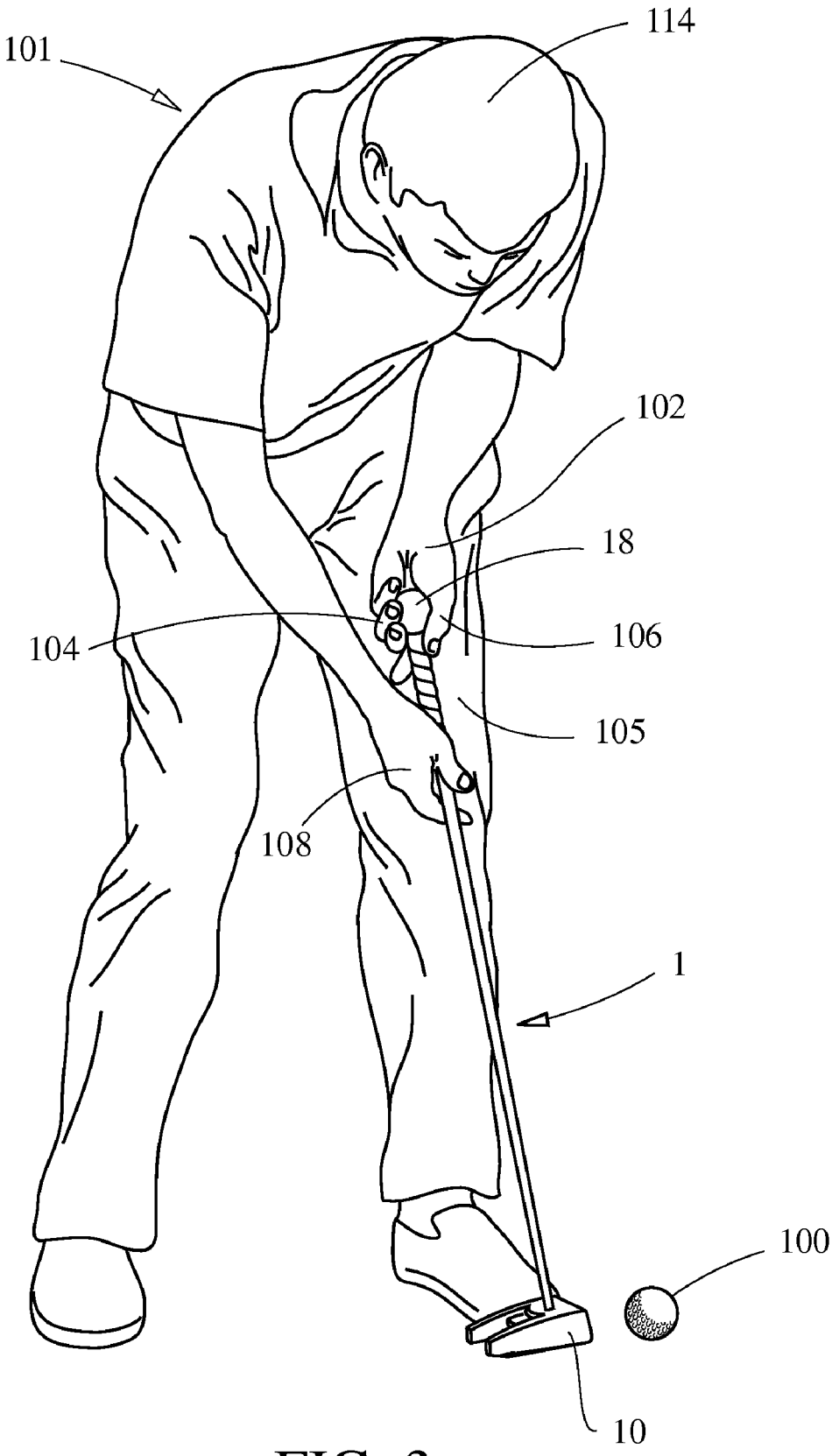
FIG. 3 is a front perspective view of a golfer in a stance of an improved putting method and apparatus in accordance with the present invention.
Figure 5:
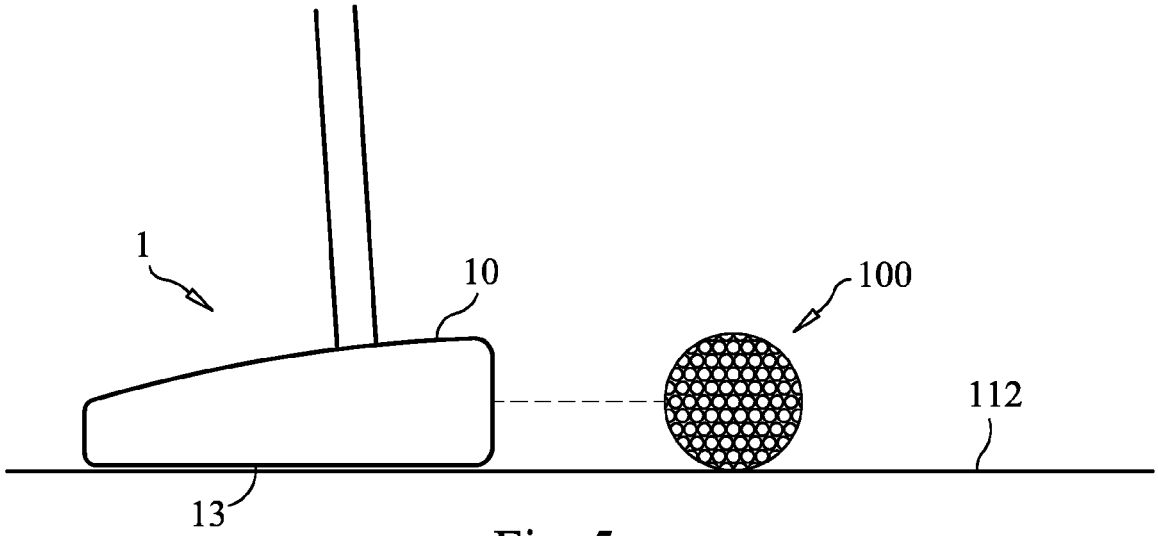
FIG. 5 is a side view of a putter head swung parallel to the ground of an improved putting method and apparatus in accordance with the present invention.
Figure 6:
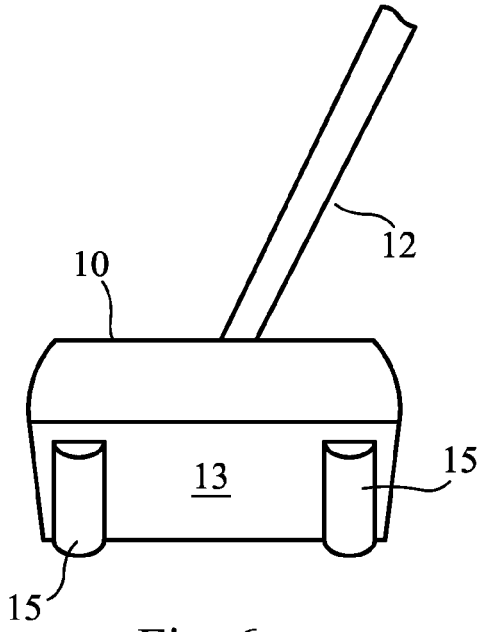
FIG. 6 is a bottom perspective view of a putter head with two slide projections extending from a bottom thereof of an improved putting method and apparatus in accordance with the present invention.

With reference now to the drawings, and particularly to FIG. 3, there is shown an improved putting method and apparatus for improving putting skill. With reference to FIGS. 1-2, the improved putting method and apparatus include an improved putter 1 and a swinging stance of specific features. The improved putter includes a putter head 10, a shaft 12 and a handle 14. The putter head 10 is attached to one end of the shaft 14 and the handle 14 is formed on the other end of the shaft 12. The putter head 10 is shown as having a substantially wedge shape. However, other designs of putter heads may also be used. With reference to FIGS. 5-6, it is preferable that a bottom 13 of the putter head 10 be substantially flat. It is further preferable that a length "A" of the putter head 10 be at least equal to or greater than a width "B" of a striking surface of the putter head 10. A longer length "A" helps keep the putter head 10 parallel to the ground during a swing.

With reference to FIG. 6, it is preferable have at least one slide projection 15 extending from the bottom 13 of the putter head 10. The at least one slide projection 15 minimizes the amount of friction between the bottom 13 of the putter head 10 and a putting surface during a swing, if the bottom 13 is slid on the ground. An outer surface of the at least one slide projection 15, which contacts the grass is preferably coated with a low friction substance, such as TEFLON. The name TEFLON is a registered trademark of the DuPont Corporation. However, the low friction substance may also be applied to the bottom 13 of the putter head 10.

The length of the shaft 12 is at least 18 inches to conform to the United States Golfing Association (USGA) rules. Further to conform to USGA rules, the shaft 12 must be bent within the first five inches from the insertion point into the putter head 10 in such a manner as to tilt the shaft a minimum of 10 degrees toward the golfer in the formal putting address position. The handle 14 includes a gripping portion 16, which is terminated with a substantially spherical ball 18. The gripping portion 16 is fabricated from a tape that is wrapped around the shaft 12. The tape has a high frictional or "grippy" outer surface. The spherical ball 18 may be fabricated out of any suitable material. An end of the spherical ball 18 may be pressed into the shaft 12 or pressed over the shaft 12. However, other assembly methods may also be used.

Figure 4:
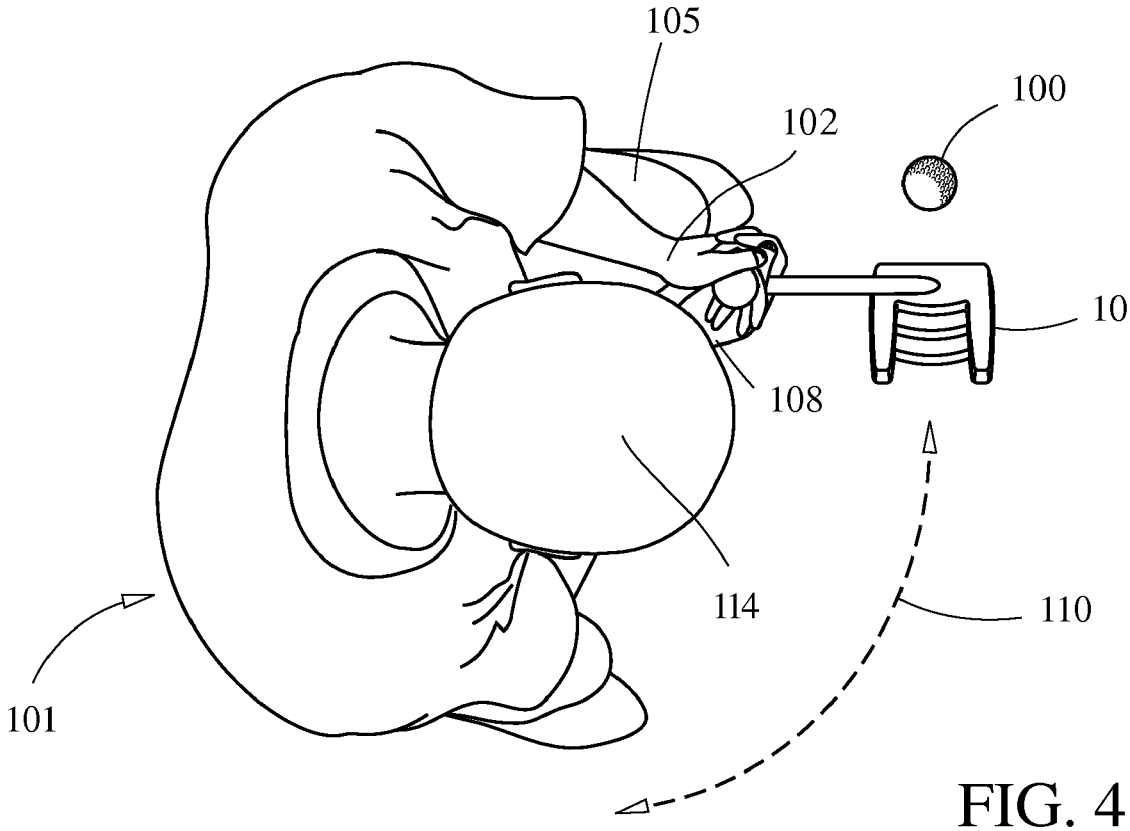
FIG. 4 is a top view of a golfer in a stance of an improved method of swinging a putter, before making an arcuate swing in accordance with the present invention.

With reference to FIG. 4, the elements of the swinging method include resting a back of one hand 102 against a leg thigh 105; placing the spherical ball 18 into the palm of one hand 102; grasping the spherical ball 18 with fingers 104 and thumb 106 of the one hand 102; grasping the gripping portion 16 with the other hand 108; and retracing an arcuate path 110 to strike the golf ball 100. Preferably, the one hand 102 is closest to the target.

With reference to FIG. 5, the putter head 10 is preferably swung parallel to a putting surface 112. The putter head 10 may be slid on the putting surface 112, such as grass or slid slightly above the putting surface 112 during the putting swing. It is preferable that a golfer 101 orient their head 114, such that their eyes look substantially vertically downward on the golf ball during the swing through the arcuate path 110.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An improved putting method, comprising the steps of:
resting a back of one hand on a leg thigh;
providing a putter having a shaft terminated with a substantially spherical ball on an end opposite a putter head;
placing said substantially spherical ball into a palm of said one hand;
grasping said substantially spherical ball with fingers and thumb of said one hand;
grasping substantially said end opposite said putter head with the other hand;
retracing an arcuate path to strike a golf ball with said putter head.

2. The improved putting method of claim 1, further comprising the step of:
sliding a bottom of said putter head parallel to a putting surface during a swing thorough said arcuate path.

3. The improved putting method of claim 1, further comprising the step of:
making contact between a bottom of said putter head and a putting surface during a swing through said arcuate path.

4. The improved putting method of claim 1, further comprising the step of:
providing said putter head with a substantially flat bottom.

5. The improved putting method of claim 4, further comprising the step of:
extending at least one slide projection from a bottom of said putter head.

6. The improved putting method of claim 1, further comprising the step of:
providing said putter head with a length that is at least equal to or greater than a width of a striking surface thereof.

7. The improved putting method of claim 1, further comprising the step of:
swinging said putter with a minimum of follow through after hitting the golf ball.

8. An improved putting method, comprising the steps of:
resting a back of one hand on a leg thigh;
providing a putter having a shaft terminated with a substantially spherical ball on an end opposite a putter head;
providing said putter head with a length that is at least equal to or greater than a width of a striking surface thereof;
placing said substantially spherical ball into a palm of said one hand;
grasping said substantially spherical ball with fingers and thumb of said one hand;
grasping substantially said end opposite said putter head with the other hand;
retracing an arcuate path to strike a golf ball with said putter head.

9. The improved putting method of claim 8, further comprising the step of:
sliding a bottom of said putter head parallel to a putting surface during a swing thorough said arcuate path.

10. The improved putting method of claim 8, further comprising the step of:
making contact between a bottom of said putter head and a putting surface during a swing through said arcuate path.

11. The improved putting method of claim 8, further comprising the step of:
providing said putter head with a substantially flat bottom.

12. The improved putting method of claim 11, further comprising the step of:
extending at least one slide projection from said bottom of said putter head.

13. The improved putting method of claim 1, further comprising the step of:
swinging said putter with a minimum of follow through after hitting the golf ball.

* * * * *